United States Patent [19]

Miskiewicz

[11] 4,385,406

[45] May 31, 1983

[54] WATER CLOSET VALVE

[76] Inventor: Leonard A. Miskiewicz, 219 Sprucewood St., Pittsburgh, Pa. 15210

[21] Appl. No.: 285,367

[22] Filed: Jul. 20, 1981

[51] Int. Cl.[3] ..... E03D 1/34; E03D 1/35

[52] U.S. Cl. ..... 4/378; 4/395; 4/403; 4/356

[58] Field of Search ..... 4/403, 378, 356, 324, 4/357, 326, 359, 327, 392, 393, 395, 396, 404

[56] References Cited

U.S. PATENT DOCUMENTS

| | | | |
|---|---|---|---|
| 874,652 | 12/1907 | Bailey | 277/169 X |
| 1,577,728 | 3/1926 | Katzin | 4/403 |
| 1,851,268 | 3/1932 | Woolley | 4/403 |
| 1,871,579 | 8/1932 | Bashara | 4/403 |
| 2,155,902 | 4/1939 | Kass | 4/403 |

*Primary Examiner*—Henry K. Artis

*Attorney, Agent, or Firm*—Thomas H. Murray

[57] ABSTRACT

An improved water closet valve is provided having two separate and distinct circular sealing rings interposed between the valve bulb and the conical opening which constitutes the valve seat. Both sealing rings may be secured to the bulb; both may be secured to the conical opening or one may be secured to the valve bulb and another to the surface of the conical opening. When the valve is in a closed position, at least two distinct spaced-apart seals are provided to obstruct the flow of water.

1 Claim, 3 Drawing Figures

WATER CLOSET VALVE

BACKGROUND OF THE INVENTION

This invention relates to an improvement in water closet valves providing at least two separate and distinct seals when the valve is in a closed position.

DISCUSSION OF THE PRIOR ART

Water closet valves are notoriously old. See U.S. Pat. Nos. 1,887,295—FREED; 1,904,898—KENNEDY; 2,004,504—LYONS; 2,190,147—CIACCIO et al. They include a generally horizontal surface having a conical opening which receives a valve bulb. The valve bulb is wider than the conical opening. The valve bulb is mounted for vertical movement above the conical opening. When the valve bulb is lifted away from the conical opening, the valve is opened and the water contained in the closet is released through the conical opening. When the water has been discharged, the valve bulb reseats itself by gravity against the conical opening and the valve remains in the closed position until the closet fills with water and thereafter seals the closet until thhe next valve activation. The wall of the valve bulb engages the surface of the conical opening to provide the valve seal.

The valve components experience wear and develop leaks which permit water to seep from the closet through the annular space between the valve bulb and the conical opening. The valve bulb normally is fabricated from a soft material such as rubber to permit it to conform readily to any irregularities in the conical opening. Nevertheless, leaking water closet valves are a common problem.

STATEMENT OF THE PRESENT INVENTION

I have provided a water closet valve having at least two distinct seals to reduce the leakage possibilities of a water closet valve. The seals preferably are circular O-rings which may be secured to the valve bulb or may be secured to the conical opening or may be secured one to the valve bulb and another to the conical opening. As the valve bulb seats against the opening, both of the circular seals engage a sealing surface. Preferably the seals are fabricated from a soft O-ring material such as rubber, silicone, neoprene, nylon, polyurethane, and the like having good resistance to corrosion in water and having good abrasion resistance.

BRIEF DESCRIPTION OF THE DRAWINGS

Referring to FIG. 1, the base of a water closet has a horizontal surface 10 usually fabricated from ceramic material in which there is a conical opening 11 for releasing water from the closet into descending plumbing (not shown). The conical opening may be provided in a plumbing fitting which is mounted in the bottom ceramic wall of the water closet, e.g., as shown in U.S. Pat. Nos. 1,887,295, 1,904,898, supra. A valve bulb 12 is provided which has a width greater than the conical opening 11 and which normally seats directly in surface engagement with the conical opening 11.

Figure 1:
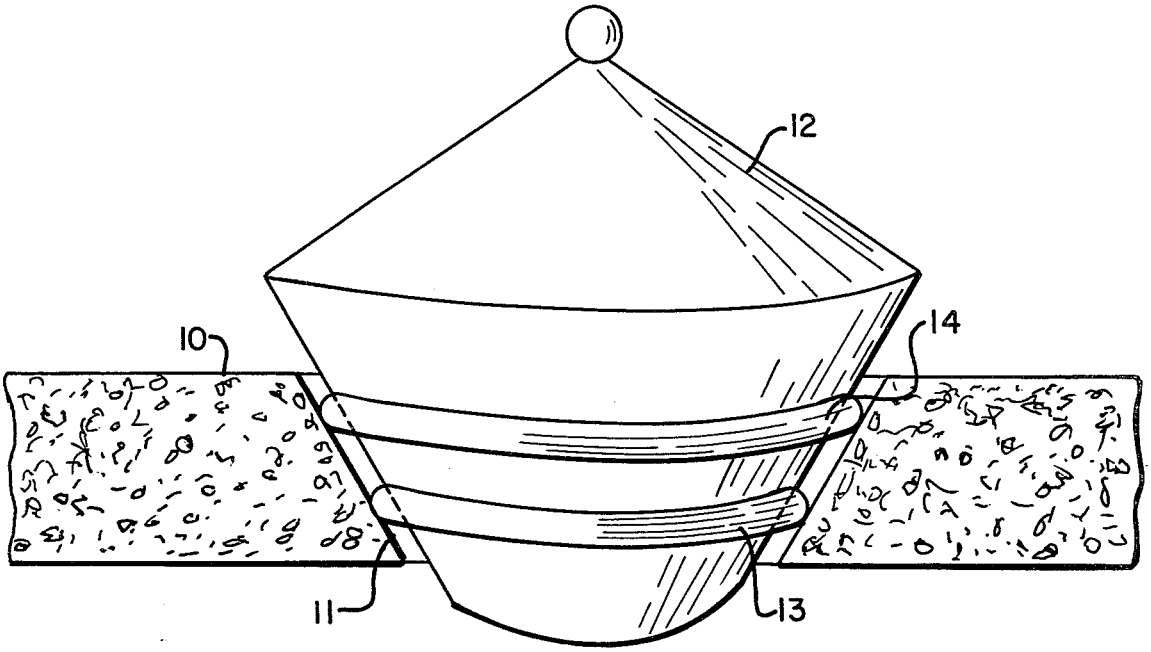
FIG. 1 is a view showing in cross-section a conical valve opening of a water closet and a valve bulb.

According to the present invention, at least two circular rings 13, 14 are provided in the region between the valve bulb 12 and the conical opening 11. The circular rings 13, 14 may be secured to the outer surface of the valve bulb 12 or may be molded into the valve bulb 12 at the time the valve bulb 12 is manufactured. Alternatively, the sealing rings 13, 14 may be secured to the surface of the conical opening 11 by an appropriate adhesive. In one embodiment, both of the sealing rings 13, 14 are secured to the valve bulb 12. In another embodiment, both of the sealing rings 13, 14 are secured to the conical surface 11. In a still further embodiment, at least one sealing ring (e.g., 13) is secured to the valve bulb 12 and another sealing ring (e.g., 14) is secured to the conical surface 11.

As the valve is in its closed position,, both of the circular sealing rings 13, 14 are interposed between the valve bulb 12 and the surface of the conical opening 11 to provide two distinct, vertically spaced-apart seals, each of which obstructs the flow of water through the conical opening 11.

The circular seals 13, 14 preferably are fabricated from resilient, corrosion-resistant, abrasion-resistant material such as rubber, silicone, neoprene, nylon, polyurethane and similar materials.

Figure 2:
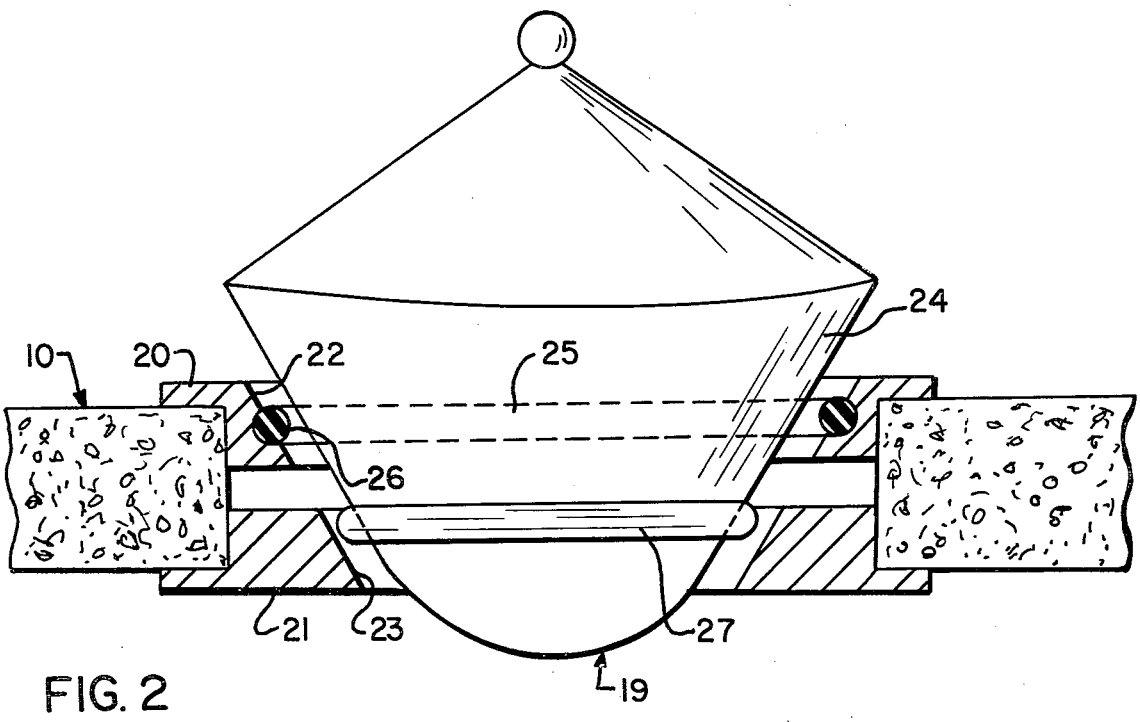
FIG. 2 is a cross-section view similar to FIG. 1 showing an alternative embodiment of the invention.

In FIG. 2, the water closet opening 19 is formed from two rings 20, 21 which are secured in a sealing relationship to the opening 19. Both rings 20, 21 have conical surfaces 22, 23, respectively. The lower ring 21 has a smaller diameter than the upper ring 20. The two surfaces 22, 23 constitute a conical opening in the sense that that expression is employed in this specification and claims. A valve bulb 24 has a shape corresponding to the surfaces 22, 23. One circular sealing ring 25 is mounted in a circular groove 26 in the surface 22.

Another circular sealing ring 27 is secured to the valve bulb 24. When the valve is in a closed position, the sealing ring 25 seats against the side wall of the valve bulb 24; the sealing ring 27 seats against the surface 23. The two rings 25, 27 provide two distinct, vertically spaced seals for the opening 19.

Figure 3:
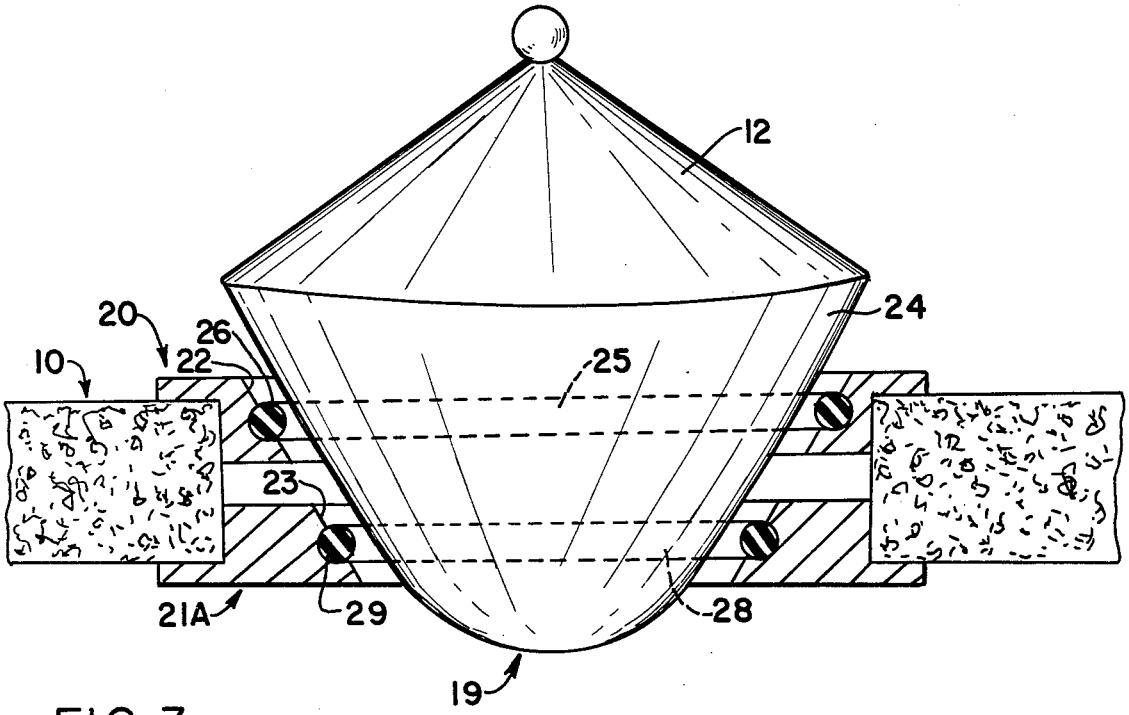
FIG. 3 is a cross-section view similar to FIG. 1 showing a further alternative embodiment of the invention.

As shown in FIG. 3, the invention may be practiced by providing one sealing ring 25 in the circular groove 26 of the surface 22 and by providing a second circular sealing ring 28 in a second circular groove 29 in the surface 23. The two rings 25, 28 provide two distinct vertically spaced seals when the bulb 12 settles into the opening 19.

I claim:

1. In a water closet valve, including a conical opening in a generally horizontal surface and a corresponding valve bulb which is wider than the opening and mounted for vertical movement above the said opening, the improvement comprising at least two vertically spaced-apart circular sealing O-rings interposed between said valve bulb and said conical opening, said O-rings comprising resilient, corrosion-resistant, abrasion-resistant material, the said two sealing O-rings being secured to the said conical opening and engage the surface of the said valve bulb when the valve is in a closed position, whereby said sealing O-ring provides a separate and distinct water seal between the said valve bulb and the said conical opening.

* * * * *